US005107172A

United States Patent [19]

Oku et al.

[11] Patent Number: 5,107,172

[45] Date of Patent: Apr. 21, 1992

[54] CHARGED-PARTICLE BEAM TUBE AND ITS DRIVING METHOD

[75] Inventors: Kentaro Oku, Fuchu; Masakazu Fukushima, Nishitama; Mitsuhiro Kurashige, Chofu; Norifumi Egami, Tokyo; Toshio Yamagishi, Kawasaki, all of Japan

[73] Assignees: Hitachi, Ltd.; Nippon Hoso Kyokai, both of Tokyo, Japan

[21] Appl. No.: 346,227

[22] Filed: May 2, 1989

[30] Foreign Application Priority Data

May 2, 1988 [JP] Japan ..... 63-107643

[51] Int. Cl.[5] ..... H01J 29/74

[52] U.S. Cl. ..... 313/432; 313/435; 313/437; 313/450

[58] Field of Search ..... 313/432, 439, 450, 433, 313/435, 437

[56] References Cited

U.S. PATENT DOCUMENTS

| | | | |
|---|---|---|---|
| 2,681,426 | 6/1954 | Schlesinger | 313/432 X |
| 4,205,253 | 5/1980 | Kakizaki et al. | 313/437 |
| 4,651,050 | 3/1987 | Tagawa et al. | 313/390 |
| 4,658,182 | 4/1987 | Araki | 313/384 |
| 4,663,560 | 5/1987 | Oku et al. | 313/390 |
| 4,728,855 | 3/1988 | Kakizaki | 313/432 X |
| 4,792,721 | 12/1988 | Oku et al. | 313/432 |

FOREIGN PATENT DOCUMENTS

| | | | |
|---|---|---|---|
| 54-121662 | 9/1979 | Japan | 313/432 |
| 62-80943 | 4/1987 | Japan . | |
| 63-310542 | 12/1988 | Japan | 313/432 |

OTHER PUBLICATIONS

Oku et al.; Electrostatic focusing and electrostatic deflection systems with reduced aperture aberrations; Nov./Dec. 1988, J. Voc. Sci. Technol. B6(6) pp. 1999–2002.

Oku et al.; Analysis on Electrostatic Pattern Yoke Camera Tubes; IEEE Transactions on Electron Devices, vol. ED-33 No. 8 Aug. 1986 pp. 1090–1097.

Hutter et al.; Electrostatic Deflection Yokes; IEEE Transactions on Electron Devices vol. ED-19 No. 6 Jun. 1972; pp. 731–745.

*Primary Examiner*—Donald J. Yusko
*Assistant Examiner*—Michael Horabik
*Attorney, Agent, or Firm*—Antonelli, Terry, Stout & Kraus

[57] ABSTRACT

A charged-particle beam tube having an envelope of a dielectric material and a pattern yoke formed on the inner surface of the envelope. The pattern yoke has a pair of horizonal deflection electrodes and a pair of vertical deflection electrodes arranged alternately. The horizontal deflection electrodes have a greater circumferential width than the vertical deflection electrodes. The horizontal and vertical deflection electrodes are supplied with different bias voltages.

29 Claims, 10 Drawing Sheets

CHARGED-PARTICLE BEAM TUBE AND ITS DRIVING METHOD

BACKGROUND OF THE INVENTION

1. Field of the Invention

The present invention relates to a system for electrostatically deflecting a charged-particle beam by means of a pattern yoke. More particularly, the invention is concerned with a charged-particle beam tube which does not cause any deterioration of the beam characteristic even when the deflection sensitivities of charged-particles in two orthogonal directions are different from each other, as well as a method of driving such a tube.

In general, in an electrostatic deflection camera tube, deflection of an electron beam is effected by an electric field produced by a pattern yoke formed on the inner surface of the tube wall. This arrangement enables any beam deflecting coil assembly to be eliminated, thus contributing to reduction in the size, weight and power consumption of video cameras. Electrostatic deflection camera tubes are broadly sorted into two types: namely, a magnetic focusing and electrostatic deflection (MS) type and an electrostatic focusing and electrostatic deflection (SS) type. MS camera tubes are disclosed, for example, in the specification of the U.S. Pat. No. 4,205,253, Japanese Patent Examined Publication No. 46-12213, Japanese Patent Examined Publication No. 57-31257, the specification of the U.S. Pat. No. 4,663,560, and Japanese Patent Unexamined Publication No. 62-206750. On the other hand, SS camera tubes are shown, for example, in the specification of the U.S. Pat. No. 4,658,182, Japanese Patent Unexamined Publication No. 61-7544 and the specification of the U.S. Pat. No. 4,792,721.

In these electrostatic deflection camera tubes, the pattern yoke is composed of a horizontal pair and a vertical pair of deflection electrodes having widths equal to each other in the circumferential direction of the camera tube so as to provide equal deflection sensitivities both in the horizontal and vertical directions. In general, however, the picture screen of a television has a rectangular form with greater dimension in the horizontal direction than in the vertical direction. In particular, the ratio of the horizontal length to the vertical length of the picture screen is as large as 16:9 in the case of modern high-definition television systems. Therefore, when the pattern yoke composed of a horizontal pair and a vertical pair of electrodes of equal circumferential widths is used, the voltage required for deflection of a beam in the horizontal direction (referred to as a horizontal deflection voltage) is higher than the voltage used for the deflection of a beam in the vertical direction (referred to as a vertical deflection voltage), and as a result the scale of the driving circuit is increased undesirably. In order to obviate this problem, it has been proposed to increase the circumferential width of horizontal deflection electrodes as compared with that of vertical deflection electrodes, as disclosed in, for example, Japanese Patent Unexamined Publication No. 62-80943 and No. 63-310542. With this arrangement, it is possible to increase the deflection sensitivity in the horizontal direction, thus enabling a reduction in the total deflection voltage inclusive of both the horizontal deflection and the vertical deflection.

However, it has been found by the applicants that the electrostatic deflection camera tube having such an arrangement of deflection electrodes suffers from the following problems. Namely, the portions of the glass wall of the tube corresponding to the gap between adjacent deflection electrodes, i.e., the portions which are exposed without being covered by the deflection electrodes, are electrostatically charged to produce an electric field called as a astigmatic electric field which acts to cause an astigmatic aberration of the electron beam. The astigmatic electric field also causes drawbacks such as a reduction in the resolution of the image and distortion of the pattern. The charging of the exposed portions of the camera tube wall glass has been encountered also with the case of a conventional camera tube in which the vertical and horizontal deflection electrodes have equal circumferential widths. In these conventional camera tubes, however, no astigmatic electric field is formed because of the symmetry of the horizontal and vertical deflection electrodes, and accordingly, no attention has been paid to the charging on the wall gaps.

SUMMARY OF THE INVENTION

Accordingly, an object of the present invention is to provide a charged-particle beam tube in which generation of an astigmatic electric field is suppressed if the electrostatic deflection tube has an asymmetrical deflection electrode arrangement, i.e., horizontal deflection electrodes of a greater circumferential width and vertical deflection electrodes of a smaller circumferential width (abbreviated as H/V asymmetry, hereinafter), thereby to prevent degradation of the beam characteristic, and to provide a method of driving such a beam tube.

These objects can be achieved by (1) applying different voltages to the horizontal and vertical deflection electrodes or by (2) forming slits in the horizontal deflection electrodes.

According to the countermeasure (1) mentioned above, a suitable potential difference is developed between the horizontal and vertical deflection electrodes as a result of application of different bias voltage to these electrodes. This potential difference generates an astigmatic electric field which is inverse to that produced by the charging of the gaps between the electrodes so that both astigmatic electric fields cancel each other.

According to the countermeasure (2) mentioned above, slits are formed in the horizontal deflection electrodes. If the shape and size of the slits are suitably selected, the charges on the portion of the tube wall glass exposed through the slits produce an astigmatic electric field which is inverse to the astigmatic electric field produced by the charges on the gaps between the electrodes. It is thus possible to extinguish any astigmatic electric field.

By using one of these countermeasures, it is possible to substantially nullify the astigmatic aberration and, hence, to prevent any degradation of resolution and an increase in image distortion which may otherwise be caused by H/V asymmetry.

DESCRIPTION OF THE PREFERRED EMBODIMENTS

Preferred embodiments of the present invention will be described with reference to the accompanying drawings.

Figure 2:
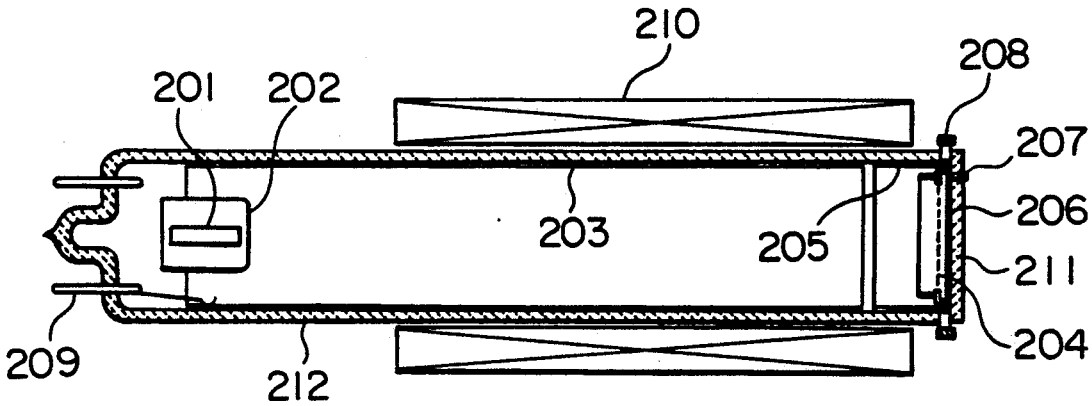
FIG. 2 is a schematic sectional view of an MS camera tube as an embodiment of the present invention.

Referring to FIG. 2 which is a schematic sectional view of an MS camera tube embodying the present invention, electrons emitted from a cathode 201 are converged into an electron beam of a fine cross-section by an aperture opening of about 10 μm formed at the center of a first grid electrode 202 to which a potential of 10 to 20 V is applied with respect to the cathode voltages. The electrode beam is focused on a target 206 under the action of the magnetic field produced by a focusing coil 210 surrounding the tube. At the same time, the electron beam is deflected in a controlled manner by deflection electrodes arranged as a pattern yoke 203 formed on the inner surface of the tube, thereby scanning the target so as to read image signals. The image signals in the form of electrical signals are delivered to the outside of the tube through a pin 207 which extends through a glass plate 211. A mesh electrode 204 is supplied with a voltage via an indium ring 208, while voltages to other electrodes are supplied through stem pins 209 which extend through the glass tube 212. A cylindrical electrode 205 formed on the inner surface of the tube is maintained at the same potential as the mesh electrode 204 and an electrostatic lens is formed between the cylindrical electrode including a mesh electrode and the pattern yoke 203. This lens is generally referred to as a collimating lens and is capable of causing deflected electrons to land upon the target perpendicularly thereto.

Typically, the first grid voltage $E_{cl}$ is 15 V, the pattern yoke bias voltage is about 550 V and the mesh electrode voltage is 1000 V, in terms of voltage with respect to the potential of the cathode.

Figure 3A:
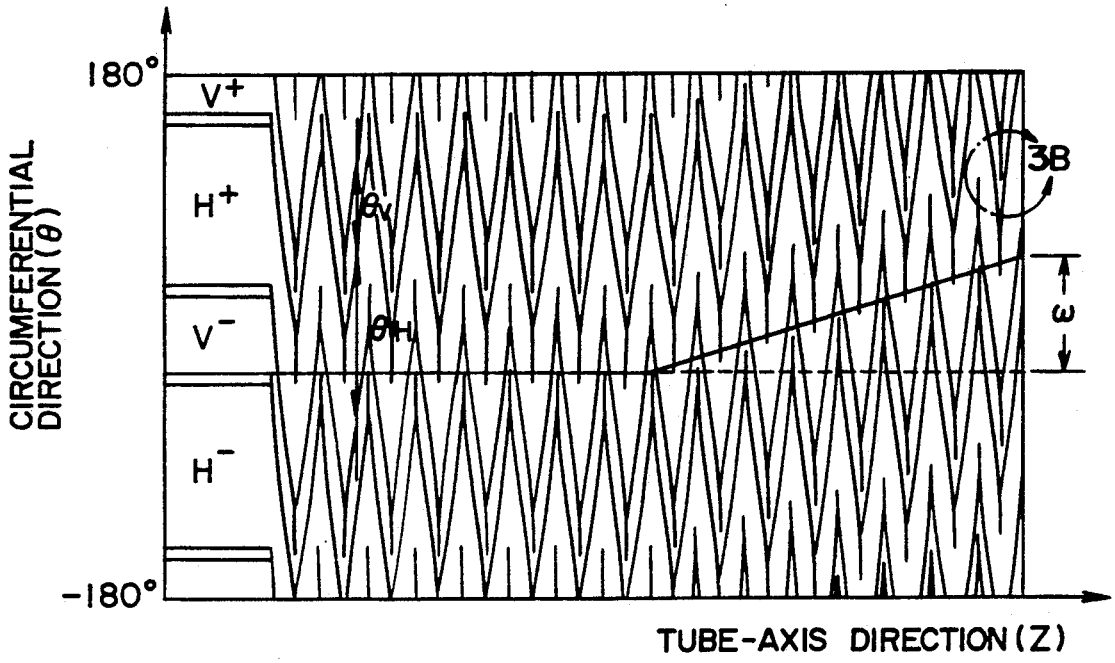
FIGS. 3A and 3B are respectively a developed view of an H/V asymmetry pattern yoke and an enlarged view of the circled portion of the pattern yoke.

FIG. 3A is a developed view of a pattern yoke suitably used in this embodiment. As is the case of a pattern yoke disclosed in Japanese Patent Unexamined Publication No. 62-206750, this pattern yoke is partially twisted. This twist angle $\omega$ is set at about 80°, in order to minimize the beam diameter, as well as picture distortion and landing error when deflected.

The horizontal/vertical deflection electrode width ratio $\theta_H/\theta_V$ is 2.075, representing the circumferential angles of the horizontal electrodes H+ and H− by $\theta_H$ and the circumferential angles of the vertical electrodes V+ and V− by $\theta_V$, as measured from the center of the gap between the adjacent electrodes. The ratio $\theta_H/\theta_V$ is determined such that the horizontal and vertical deflection voltages are equal to each other when the aspect ratio of the scanning region is 16:9. The gap between the electrodes is 1 mm as measured in the circumferential direction $\theta$. This corresponds to 7.16° since the inside diameter of the tube is 16 mm. The applicants have conducted experiments and found that the tube wall portion corresponding to the gap between the electrodes were charged to about +20 V as a mean value. In the illustrated case, the potential of the gap portion is +19 V.

Figure 4:
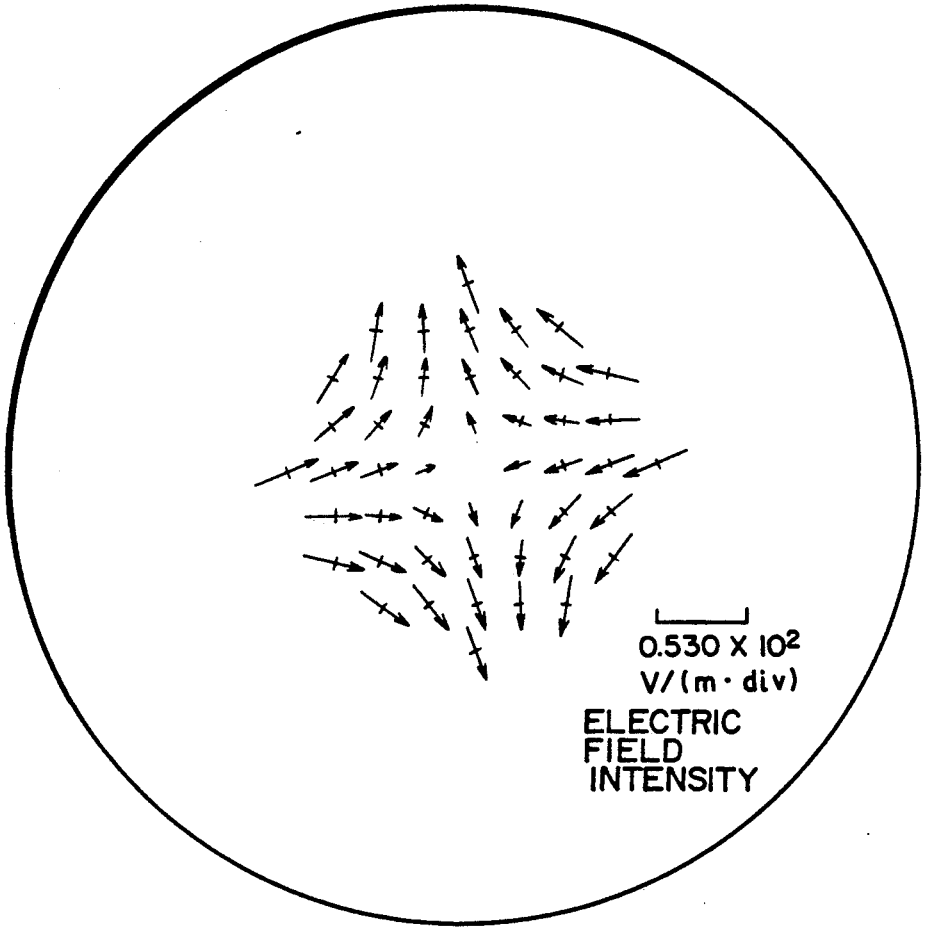
FIG. 4 is an illustration of an astigmatic electric field generated by charging of gaps between deflection electrodes.

FIG. 4 illustrates the electric field caused by this electrostatic charging of the gap portion when the equal bias voltages are applied to deflection electrodes. More specifically, this figure shows vectors of the electric field as observed in an x-y plane taken at a certain fixed position on the Z-axis of the tube, i.e., at the midpoint between the first grid 202 and the mesh electrode, (fields are shown only in a region which is within 40% in terms of the tube inside diameter). From this figure, it will be seen that a so-called astigmatic electric field as a quadrupole electric field has been formed. An axial symmetric electric field is superposed to this astigmatic electric field thereby forming the electrostatic lens.

Figure 5:
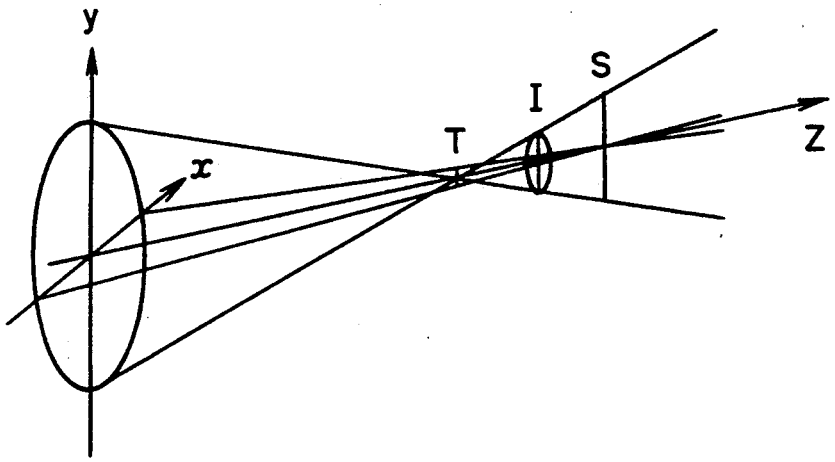
FIG. 5 is a schematic view illustrating the conception of astigmatism.

As will be seen from FIG. 5, the electron beam cannot be focused into a point but is focused in a line on a tangential image planet and a sagittal image planes, due to the presence of the astigmatic electric field. In consequence, the beam is undesirably spread or expanded at the position I where the beam cross-section approaches a circle, i.e., at the position where the maximum diameter of the beam cross-section is the smallest. This phenomenon is known as an astigmatic aberration.

Figure 6A:
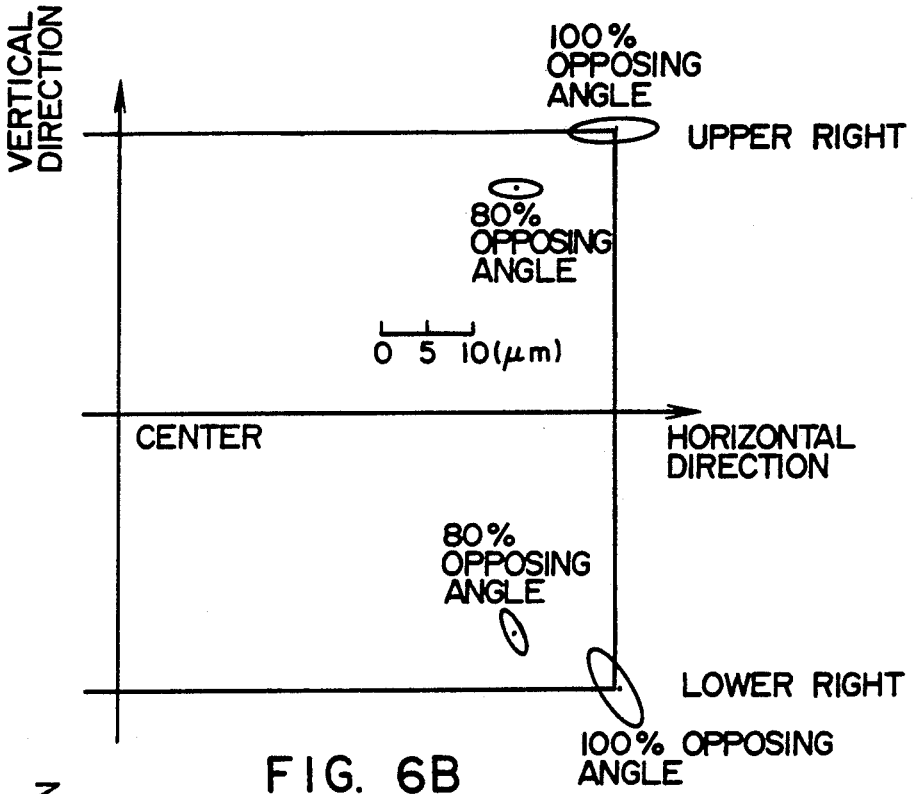
FIGS. 6A and 6B are illustrations of the manner of beam spread as observed when the tube wall portions under the gap between the deflection electrodes are not charged and when the tube wall portions are charged, respectively, in comparison with each other.
Figure 6B:
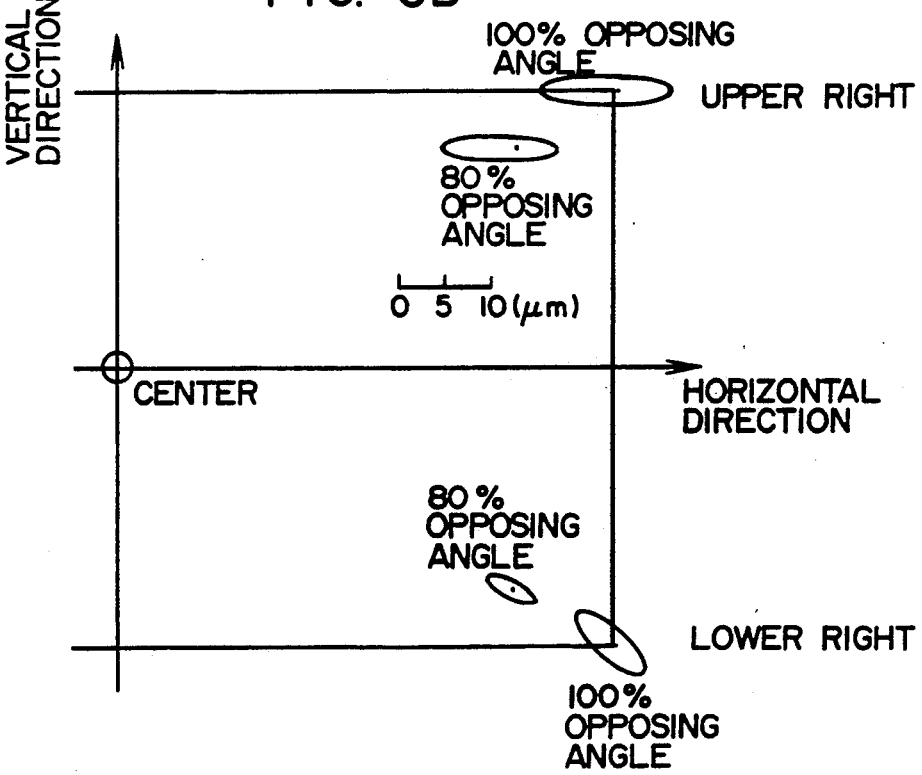

FIGS. 6A and 6B show analyzed results of beam spreads on the scanning plane without and with the influence of the astigmatic electric field, respectively. In this situation, the scanning plane s defined by the rectangular portion of the target 206 scanned by the electron beam and the beam spreads are calculated for the electron beam which diverges from the center of the first grid 202 with a 1 degree divergent angle. More specifically, FIG. 6A shows the state as observed when there is no charge on the tube wall portion of the gap between the electrodes which will be denoted hereinafter simply as "the wall gaps" i.e., when there is no astigmatic electric field, while FIG. 6B shows the state obtained under the influence of an astigmatic electric field. The states shown in FIGS. 6A and 6B are obtained when the electrical current supplied to the focusing coil is adjusted so as to minimize the maximum diameter of the beam at the center of the scanning plane.

From a comparison between FIGS. 6A and 6B, it will be understood that the presence of an astigmatic electric field causes the beam diameter to be increased not only at the center of the scanning plane but also in the peripheral region of the image. This suggests that the charging on the wall gaps reduces the resolution of the camera tube.

Figure 7A:
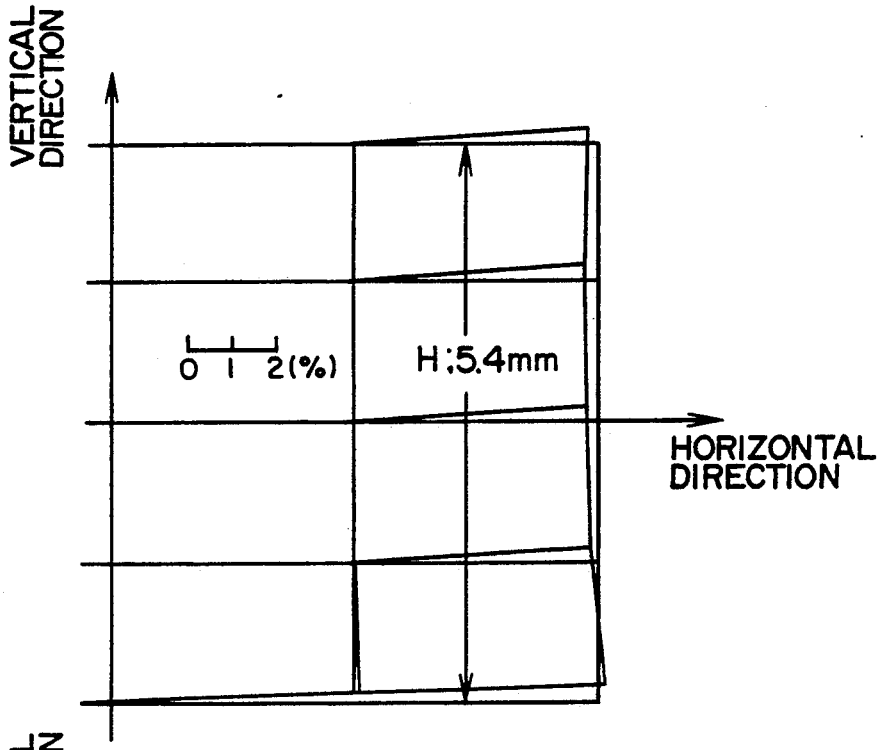
FIGS. 7A and 7B are illustrations of the manner in which a beam raster is distorted as observed when the tube wall portions an the gaps between the deflection electrodes are not charged and when the tube wall portions are charged, respectively, in comparison with each other.
Figure 7B:
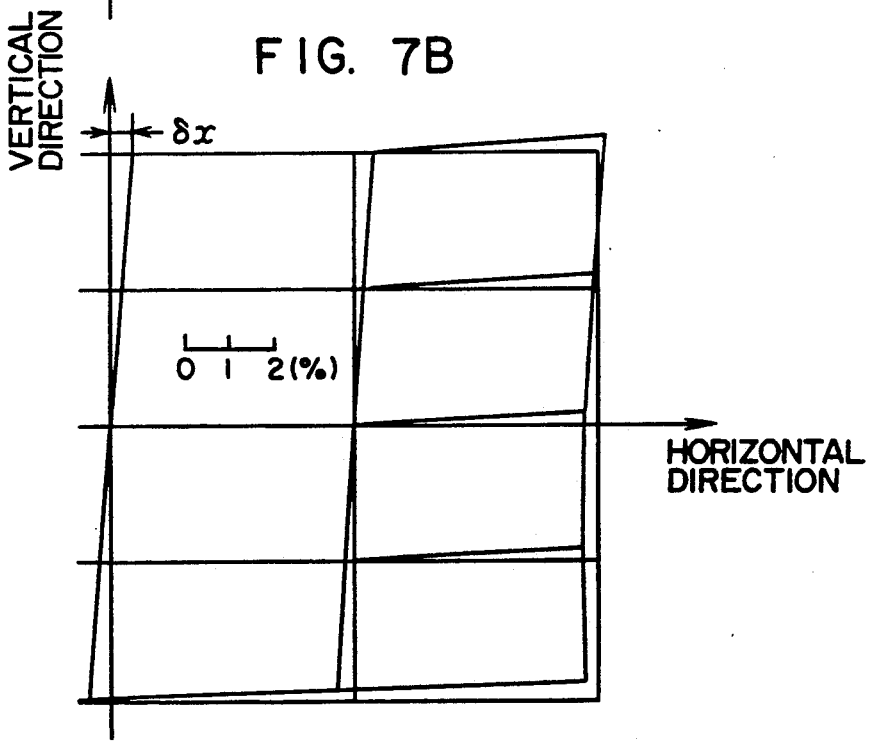

FIGS. 7A and 7B show that the analyzed results of the raster distortion without and with the influence of the astigmatic electric field caused by charging on the wall gaps, respectively. The distortion is expressed in terms of offset or deviation from an ideal rectangular scanning plane and is enlarged to be seen easier. FIGS. 7A and 7B correspond, respectively, to a state in which no astigmatic electric field exists and a state in which an astigmatic electric field exists. From the comparison between FIGS. 7A and 7B, it will be seen that a scanning plane scribed by the electron beam is distorted into a parallelopiped form, i.e., skewed, due to the presence of the astigmatic electric field. The distortion $\delta X$ is as large as about 0.5% when normalized by the height of the scanning plane.

According to the invention, the degradation of the resolution and the increase in the skew distortion attributable to the presence of an astigmatic electric field are avoided by either one of the following two measures.

According to a first measure, the bias voltage $E_{defH}$ applied between the horizontal deflection electrodes $H^+$, $H^-$ and the bias voltage $E_{defV}$ applied between the vertical deflection electrodes $V^+$, $V^-$ are different from each other, so that an astigmatic electric field is generated to compensate the astigmatic electric field produced by charging in the wall gaps.

Figure 8:
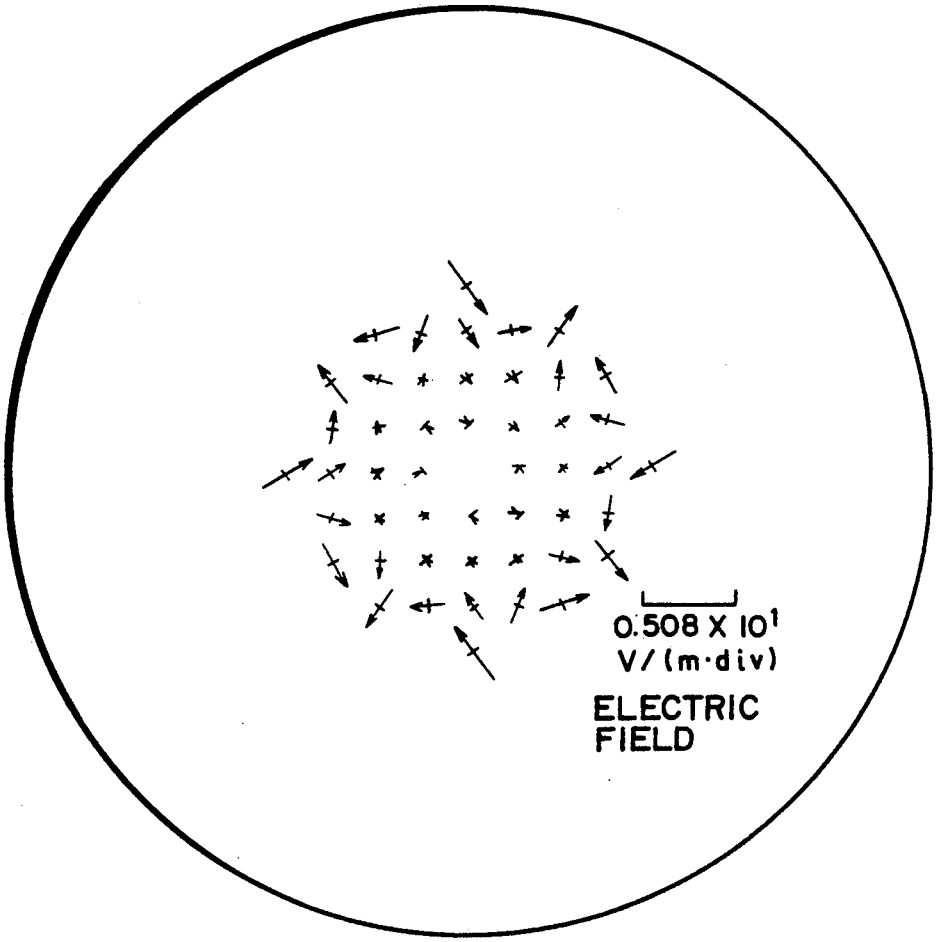
FIG. 8 is an illustration of the manner in which an astigmatic electric field, which is produced by partial charging on the tube wall portions between deflection electrodes at 19 V, is cancelled by application of a suitable astigmatic voltage (3 V)

FIG. 8 illustrates an electric field which is observed when an astigmatic voltage ($E_{defH}-E_{defV}$) of 3 V is applied under the condition where the wall gaps have been charged to +19 V. From this figure, it will be seen that the astigmatic electric field is cancelled almost perfectly in the region near the axis of the tube by the application of the suitable level of astigmatic voltage.

Figure 9A:
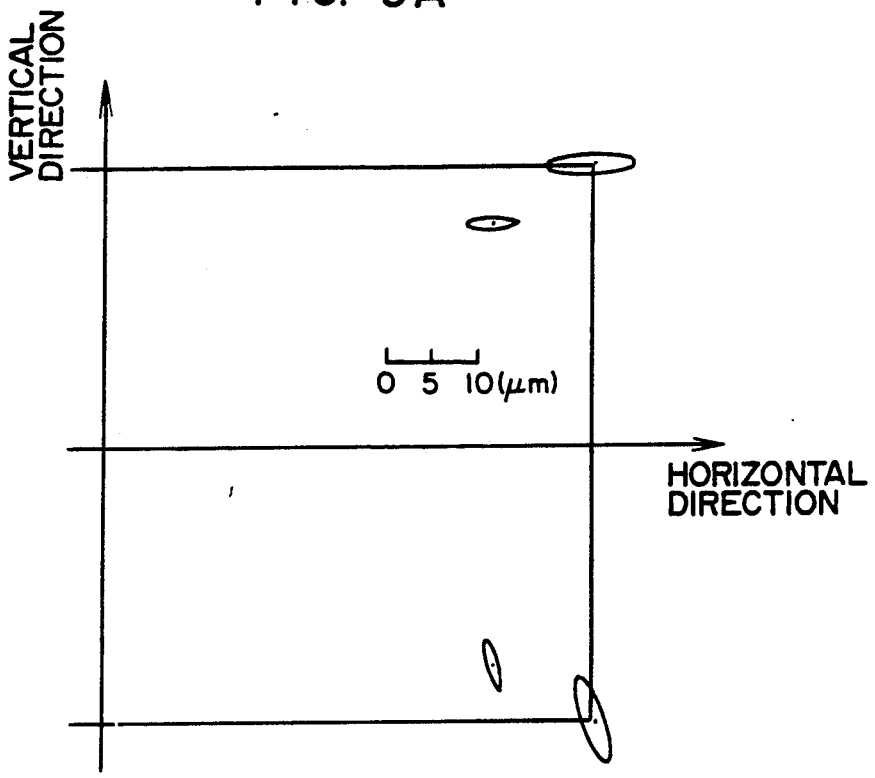
FIGS. 9A and 9B are illustrations of the manner in which beam spreads and a raster distortion are suppressed by application of a suitable level of astigmatic voltage.
Figure 9B:
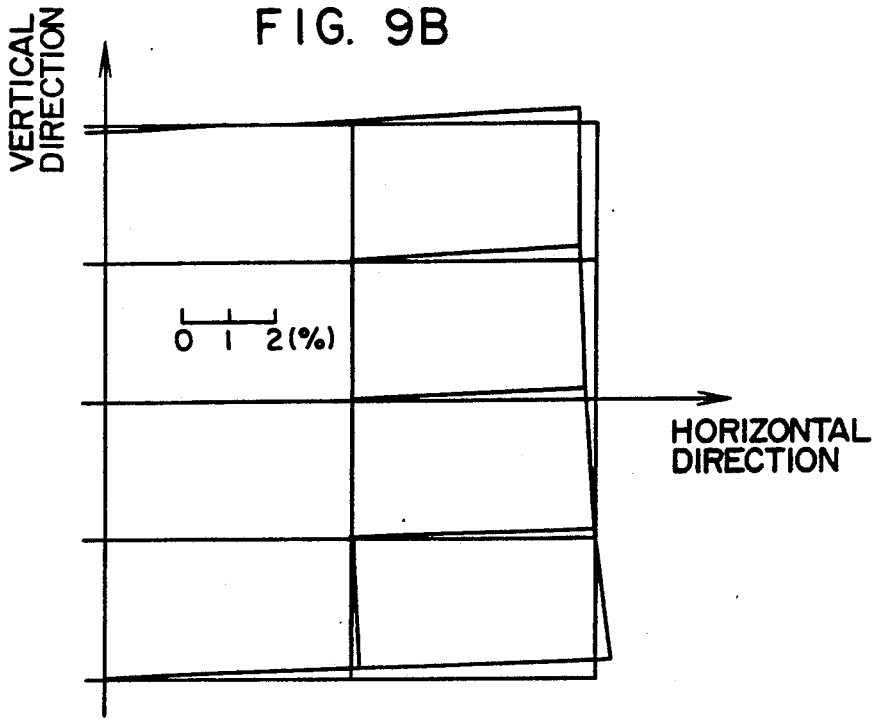

FIGS. 9A and 9B illustrate beam spreads and a raster distortion as observed under the application of the suitable astigmatic voltage. From a comparison between FIG. 9A and FIG. 6A, it will be understood that the astigmatic aberration of the beam is cancelled almost completely and the beam is focused into a point at the center of the scanning plane by the application of the suitable astigmatic voltage. It will be seen also that the beam diameter is reduced almost to the same size as that obtained when there is no charge on the tube wall portions on the electrode gap, even when the beam is deflected, as a result of application of the suitable astigmatic voltage.

It will also be understood from FIG. 9B that the skew distortion has been cancelled almost perfectly by the application of the suitable astigmatic voltage.

Thus, any deterioration of the beam characteristic caused by wall gaps can be compensated for almost completely by the application of an astigmatic voltage.

According to the second measure proposed by the present invention, a slit or slits are formed in a portion or over the entire region of each horizontal deflection electrode $H^+$ and $H^-$, so that any astigmatic electric field caused by the charges on the tube wall portions on the electrode gaps is cancelled by an astigmatic electric field which is produced by charging on the tube wall portions around the slits.

Figure 1:
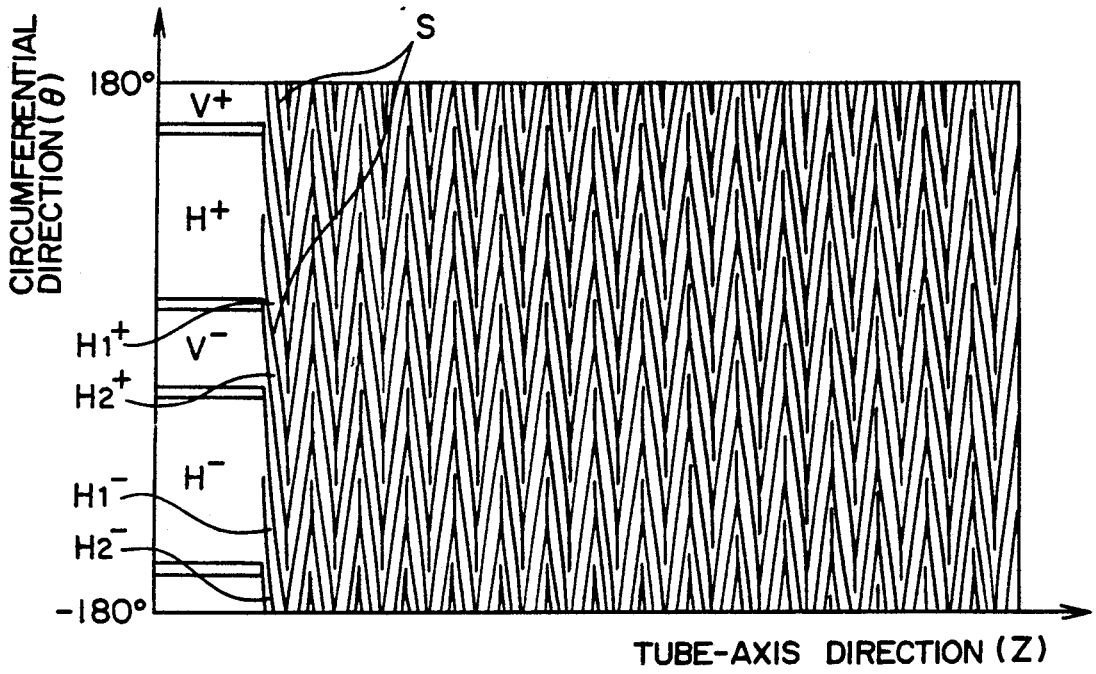
FIG. 1 is a developed view of a pattern yoke used in an embodiment of the present invention.

Referring to FIG. 1, slits S are formed along the zig-zag forms of the deflection electrodes. In this arrangement, each of the horizontal deflection electrodes $H^+$ and $H^-$ are divided into equal two parts, with each part having the same shape as the vertical deflection electrodes $V^+$ and $V^-$. Thus, the yoke pattern is composed of six equally-shaped electrodes $H^+_1$, $H_2^+$, $H^-_1$, $H_2^-$, and $V^-$.

Figure 10:
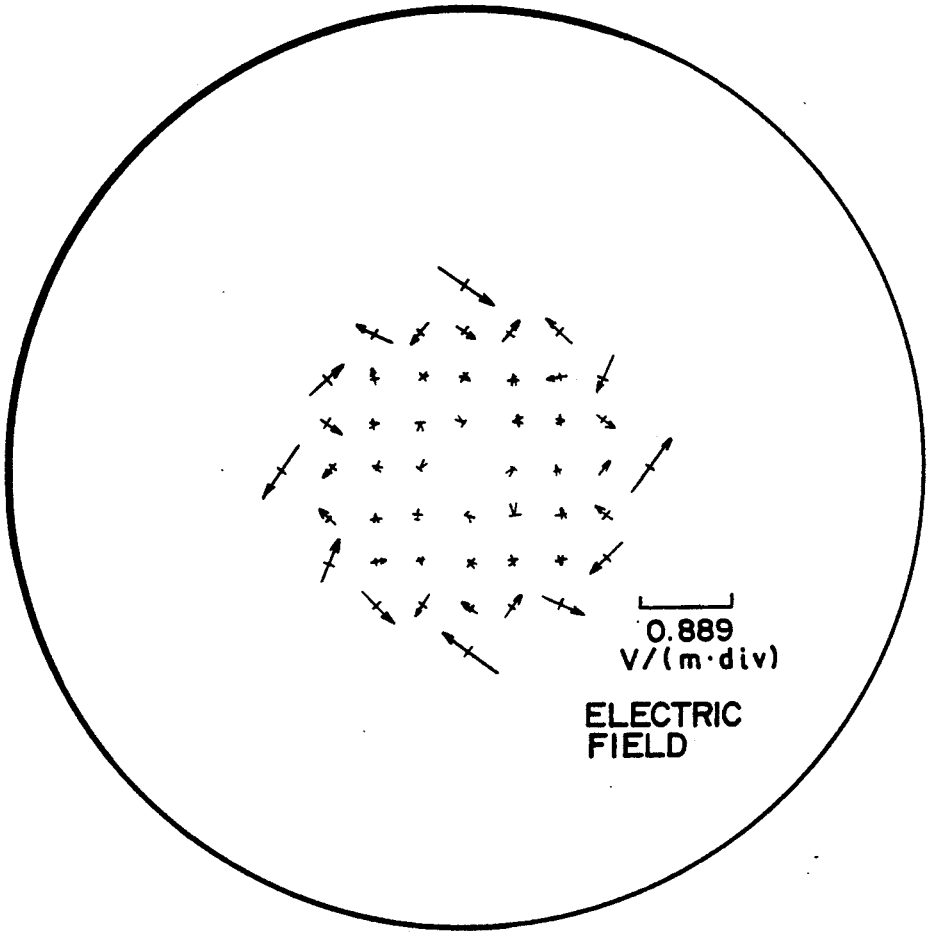
FIG. 10 is an illustration of an electric field produced by partial charging on the tube wall portions between deflection electrodes arranged in accordance with the pattern yoke of FIG. 1.

FIG. 10 shows the result of a computation of the electric field produced by charging on the wall gaps and the slits. It will be seen that no astigmatic electric field has been generated by charging on the tube walls and the slits, since in this case the pattern yoke is composed of six electrodes which are symmetrically arranged at 60° interval in the circumferential direction. Accordingly, it is understandable that the electrode gaps are averaged in the circumferential direction. This is equivalent to the conventional arrangement in which the horizontal and vertical deflection electrodes having equal circumferential width are arranged at a 90° interval in the circumferential direction, i.e., the pattern yoke is composed of four electrodes arranged in symmetry.

Figure 11A:
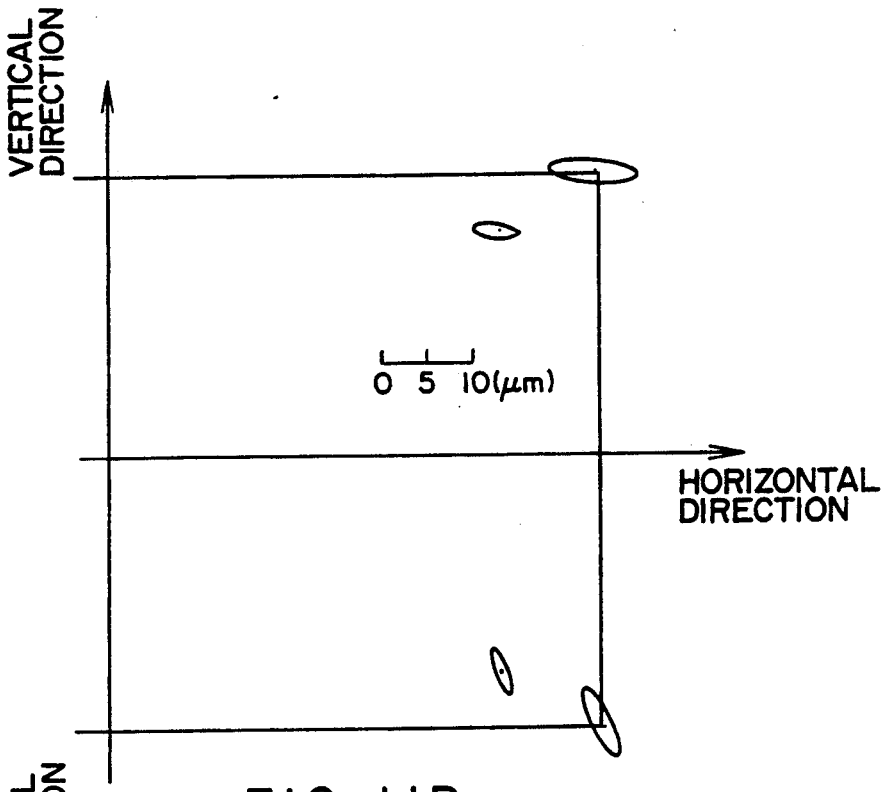
FIGS. 11A and 11B are illustrations of manners of beam spread and raster distortion caused by partial charging on the tube wall portions under gaps between deflection electrodes of the pattern yoke shown in FIG. 1 as observed when the charging potential is +19 V.
Figure 11B:
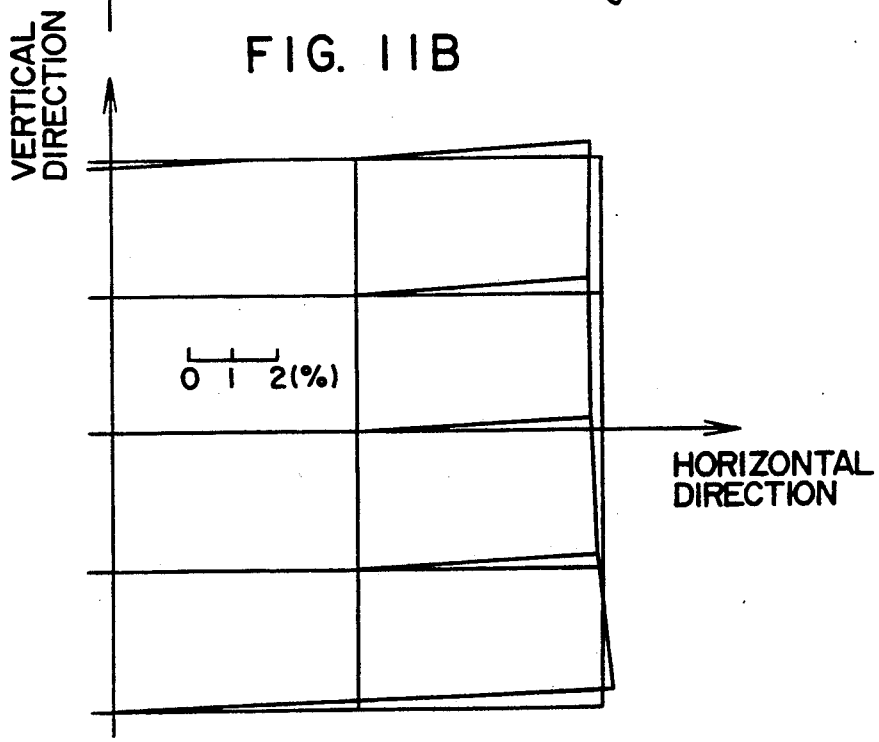

FIGS. 11A and 11B show, respectively, the beam spreads the raster distortion, under the influence of changing on the wall gaps to a potential of +19 V. A comparison of these figures with FIGS. 6A, 6B and 7A, 7B will show that, by virtue of the provision of slits in the horizontal deflection electrodes, the astigmatic aberration and the skew distortion are cancelled almost perfectly so as to provide a beam characteristic substantially equivalent to that obtained in the absence of charging on the wall gaps. It is noted that if slits are formed in the vertical deflection electrodes, it augments the astigmatic electric field which causes the astigmatic aberration and the skew distortion.

Figure 12A:
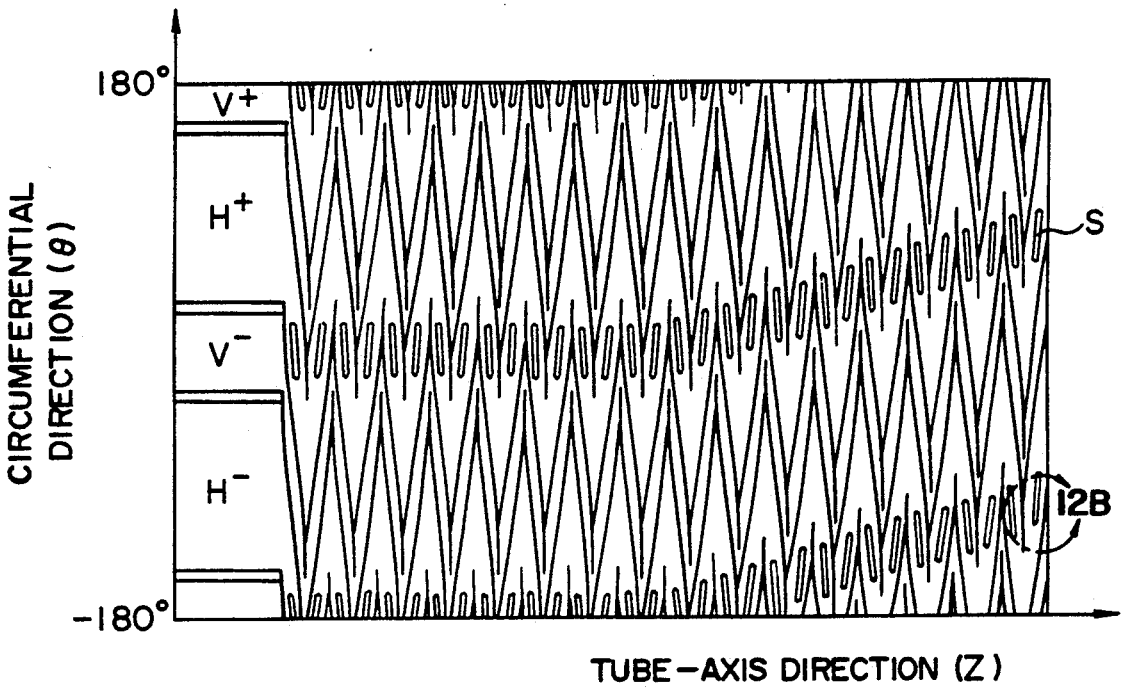
FIGS. 12A and 12B are respectively a developed view of a pattern yoke used in another embodiment of the present invention, and an enlarged view of the circled portion of the pattern yoke.

FIG. 12A illustrates another embodiment which relies upon the second measure of the invention. In this embodiment, the slits provided in each of the horizontal deflection electrodes $H^+$ and $H^-$ are not continuous, but discrete unlike the embodiment explained in connection with FIG. 1. The astigmatic electric field can be cancelled almost perfectly also in this case, by suitably determining the sizes and shapes of the discontinuous slits.

Figure 12B:
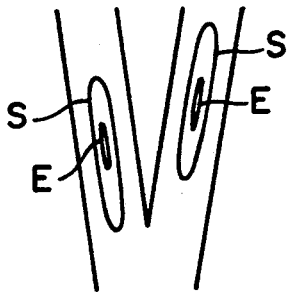

As shown in FIG. 12B, a similar effect can be attained by providing a mesh-type electrode E in each slits. In such a case, the portions of the tube wall glass exposed through the apertures of the mesh electrode are charged so as to generate an astigmatic electric field which cancels the astigmatic electric field produced by charging on the wall gaps.

It will also be understood that, in the case where the deflection electrode is divided into two halves by slits, electrical conduction between these two halves can be maintained easily by the provision of a mesh electrode in the slit.

Figure 3B:
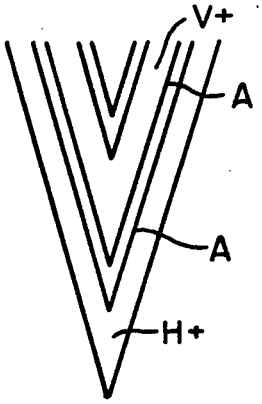

As shown in FIG. 3A, and in particular, FIG. 3B, the invention may be modified such that the wall gaps are covered or coated an anti-static agent having a very high resistance, so as to suppress generation of the astigmatic electric field which may otherwise be generated by charges accumulated on such tube wall portions.

Although the invention has been described with specific reference to MS camera tubes, it will be clear to those skilled in the art that the invention is equally applicable to SS camera tubes. It will also be understood that the invention can also be applied to devices other than the described camera tubes, such as an electrostatic deflection system for deflecting beams of charged particles including ion beams and electron beams.

As has been described, according to the invention, it is possible to present any degradation in the resolution and enhancement of skew distortion which may otherwise be caused when the beam is deflected with different deflection sensitivity levels in two orthogonal directions in a charged-particle deflection system employing a pattern yoke composed of H/V asymmetric deflection electrodes.

What is claimed is:

1. A charged-particle beam tube comprising an envelope made of a dielectric material and a pattern yoke formed on the inner surface of the envelope, said pattern yoke having two orthogonal pairs of deflection electrodes defining respective gaps therebetween for deflecting a charged-particle beam in two orthogonal directions, and said pairs of deflection electrodes having different circumferential widths and having different bias voltages applied thereto, whereby said different bias voltages produce a correction astigmatic electric field which cancels a detrimental astigmatic electric field produced by charges in said gaps.

2. A charged-particle beam tube according to claim 1, wherein a potential difference between said bias voltages produces first astigmatic electric fields, charges of gaps between said electrodes produce second astigmatic electric fields, and said astigmatic electric field cancel each other.

3. A charged-particle beam tube according to claim 1, wherein said pattern yoke has a zig-zag curved arrow-like pattern.

4. A charged-particle beam tube according to claim 1, wherein said pattern yoke consists of said two orthogonal pairs of deflection electrodes.

5. A charged-particle beam tube according to claim 4, wherein one pair of said deflection electrodes has a greater circumferential width than the circumferential width of another pair of said deflection electrodes and the one pair has a bias voltage higher than that of the pair of deflection electrodes having the smaller circumferential width.

6. A charged-particle beam tube according to claim 1, wherein deflection voltages are periodically superimposed with said different bias voltages on said pairs of electrodes.

7. A charged-particle beam tube comprising an envelope made of a dielectric material and a pattern yoke formed on the inner surface of the envelope, said pattern yoke having two orthogonal pairs of deflection electrodes for deflecting a charged-particle beam in two orthogonal directions, said pairs of deflection electrodes having different circumferential widths, and one pair of said deflection electrodes having a greater circumferential width than the circumferential width of another pair of said electrodes, the one pair including at least one slit formed therein, wherein said at least one slit produces first astigmatic electric fields, charges of gaps between said electrodes produce second astigmatic electric fields, and said first and second astigmatic electric fields cancel each other.

8. A charged-particle beam tube according to claim 7, wherein both of said deflection electrodes included within said pair of electrodes having the smaller circumferential width are slitless.

9. A charged-particle beam tube according to claim 7, wherein discrete, discontinuous slits are provided in each of said deflection electrodes including within the one pair of said deflection electrodes having the greater circumferential width.

10. A charged-particle beam tube according to claim 7, wherein said at least one slit divides an associated deflection electrode from among the one pair of electrodes having the greater circumferential width into two halves of substantially equal shapes.

11. A charged-particle beam tube according to claim 10, wherein each of said halves of said associated electrode has a shape substantially equal to that of the deflection electrodes included within the pair of electrodes having the smaller circumferential width.

12. A charged-particle beam tube according to claim 7, wherein said pattern yoke has a zig-zag curved arrow-like pattern.

13. A charged-particle beam tube comprising an envelope made of a dielectric material and a pattern yoke formed on the inner surface of the envelope, said pattern yoke having two orthogonal pairs of deflection electrodes for deflecting a charged-particle beam in two orthogonal directions, and said pairs of deflection electrodes having different circumferential widths, one pair of said deflection electrodes having a greater circumferential width than the circumferential width of another pair of said electrodes and the one pair including at least one slit formed therein, wherein a mesh electrode is provided in each of said slits.

14. A charged-particle beam tube comprising an envelope made of a dielectric material and a pattern yoke formed on the inner surface of the envelope, said pattern yoke having two orthogonal pairs of deflection electrodes for deflecting a charged-particle beam in two orthogonal directions, and said pairs of deflection electrodes having different circumferential widths, one pair of said deflection electrodes having a greater circumferential width than the circumferential width of another pair of said electrodes and the one pair including at least one slit formed therein, wherein said at least one slit divides an associated deflection electrode from among the one pair of electrodes having the greater circumferential width into two halves of equal shapes.

15. A charged-particle beam tube comprising an envelope made of a dielectric material and a pattern yoke formed on the inner surface of the envelope, said pattern yoke having two orthogonal pairs of deflection electrodes for deflecting a charged-particle beam in two orthogonal directions, said pairs of deflection electrodes having different circumferential widths, and portions of the inner surface of said envelope exposed through gaps between said deflection electrodes being coated with an anti-static agent.

16. A charged-particle beam tube according to claim 15, wherein said pattern yoke has a zig-zag curved arrow-like pattern.

17. A charged-particle beam tube according to claim 15, wherein said pattern yoke consists of said two orthogonal pairs of deflection electrodes.

18. A charged-particle beam tube comprising an envelope made of a dielectric material and a pattern yoke formed on the inner surface of the envelope, said pattern yoke having six deflection electrodes arranged substantially in symmetry at 60° circumferential intervals, and said six deflection electrodes including two electrically connected pairs of adjacent deflection electrodes.

19. A charged-particle beam tube according to claim 18, wherein said pattern yoke has a zig-zag curved arrow-like pattern.

20. A method of driving a charged-particle beam tube having an envelope made of a dielectric material and a pattern yoke formed on the inner surface of the envelope, comprising the steps of: forming said pattern respective gaps therebetween and having different circumferential widths for deflecting a charged particle beam in two orthogonal directions; and applying different bias voltages to said pairs of deflection electrodes, respectively, so as to produce a correction astigmatic field, whereby said correction astigmatic field cancels a detrimental astigmatic field produced by charges in said gaps.

21. A method of driving a charged-particle beam tube according to claim 20, wherein a potential difference between said bias voltages produces first astigmatic electric fields, charges of gaps between said electrodes produce second astigmatic electric fields, and said astigmatic electric field cancel each other.

22. A method of driving a charged-particle beam tube according to claim 20, further comprising the step of periodically superimposing deflection voltages with the different bias voltages on said pairs of electrodes.

23. A method according to claim 21 wherein said pattern yoke has a zig-zag curved arrow-like pattern.

24. A charged-particle beam tube comprising an envelope made of a dielectric material and a pattern yoke which is formed on the inner surface of the envelope and which consists of two orthogonal pairs of deflection electrodes with different circumferential widths for deflecting a charged particle beam in two orthogonal directions, wherein at least one of said deflection electrodes included within one of said pairs of electrodes having a greater circumferential width than another of said pairs of electrodes having a smaller circumferential width is formed with at least one slit, and each of said deflection electrodes included within said pair of electrodes having the smaller circumferential width is slitless.

25. A charged-particle beam tube comprising an envelope made of a dielectric material and a pattern yoke formed on the inner surface of the envelope, said pattern yoke having first, second, third, fourth, fifth and sixth deflection electrodes arranged substantially in symmetry at 60° circumferential intervals, and said first and second deflection electrodes and said fourth and fifth deflection electrodes being electrically connected, respectively.

26. A changed-particle beam tube according to claim 25, wherein said pattern yoke has a zig-zag curved arrow-like pattern.

27. A method of driving a charged-particle beam tube having an envelope made of a dielectric material and a pattern yoke which is formed on the inner surface of the envelope and which consists of two orthogonal pairs of deflection electrodes with different circumferential widths for deflecting a charged particle beam in two orthogonal directions, said method comprising the step of applying different bias voltages to said two orthogonal pairs of deflection electrodes.

28. A method according to claim 27, wherein one pair of said deflection electrodes having a greater circumferential width than another pair of said deflection electrodes having a smaller circumferential width receives a bias voltage higher than that received by the pair of deflection electrodes having the smaller circumferential width.

29. A method according to claim 27, further comprising the step of superimposing different deflection voltages with the different bias voltages on said pairs of electrodes.

* * * * *